US005419468A

United States Patent [19]

Taki

[11] Patent Number: 5,419,468

[45] Date of Patent: May 30, 1995

[54] DEVELOPING TONER SUPPLY DEVICE WITH DETACHABLE TONER CARTRIDGE AND TONER SUPPLY SHIELDING MEMBER

[75] Inventor: Eiji Taki, Inazawa, Japan

[73] Assignee: Brother Kogyo Kabushiki Kaisha, Nagoya, Japan

[21] Appl. No.: 86,898

[22] Filed: Jul. 7, 1993

[30] Foreign Application Priority Data

Jul. 17, 1992 [JP] Japan ..... 4-213667

[51] Int. Cl.[6] ..... B65D 47/00; B67D 3/00; G03G 15/06

[52] U.S. Cl. ..... 222/554; 222/DIG. 1; 355/260

[58] Field of Search ..... 355/260, 245, 246; 222/DIG. 1; 118/657, 658, 325, 554

[56] References Cited

U.S. PATENT DOCUMENTS

| | | | |
|---|---|---|---|
| 659,977 | 10/1900 | Kitterman | 222/554 |
| 1,967,797 | 7/1934 | White | 222/554 |
| 2,126,815 | 8/1938 | Rest | 222/554 |
| 3,116,857 | 1/1964 | Lehman et al. | 272/554 X |
| 3,512,944 | 5/1970 | Craig et al. | 222/554 X |
| 4,588,280 | 5/1986 | Ogawa et al. . | |
| 4,606,990 | 8/1986 | Yoshikawa | 222/DIG. 1 X |
| 4,607,938 | 8/1986 | Hosoi et al. | 118/657 X |
| 5,266,998 | 11/1993 | Lee | 355/245 X |
| 5,270,785 | 12/1993 | Kita et al. | 355/260 |

*Primary Examiner*—A. T. Grimley
*Assistant Examiner*—Shuk Y. Lee
*Attorney, Agent, or Firm*—Oliff & Berridge

[57] ABSTRACT

In this developing toner supply device, the main body of a toner cartridge having an unused toner storing room is designed in a longitudinal vessel shape. A projecting portion is projected from the front wall of the cartridge at the casing side to engage with the recess portion of a toner storing portion. A semi-circular support wall is formed at the projecting portion to project toward the unused toner storing room side. A longitudinally-extending cartridge side opening is formed on the support wall. A semi-cylindrical cartridge side rotating member engages with the cartridge side and opens rotatably between the closing position where the cartridge side opening is closed and the opening position where the cartridge side opening is opened. When the toner cartridge is detached from the casing, the cartridge side opening is closed. The flat side surface of the cartridge side rotating member serves as the outer surface of the toner cartridge. Accordingly, toner attachment to the outer surface of the toner cartridge can be avoided as much as possible.

30 Claims, 12 Drawing Sheets

DEVELOPING TONER SUPPLY DEVICE WITH DETACHABLE TONER CARTRIDGE AND TONER SUPPLY SHIELDING MEMBER

BACKGROUND OF THE INVENTION

1. Field of the Invention

This invention relates to a developing toner supply device, and, more particularly, to a developing toner supply device having a developing toner cartridge detachably mounted thereto.

2. Description of Related Art

A developing toner supply device supplies a developing device with developing toner that develops a latent image formed on a photosensitive drum in an electrophotographic recording apparatus. The developing toner is stored in a casing of the developing toner supply device. The amount of developing toner in the casing decreases through a developing toner supplying operation from the developing toner supply device to the developing device.

Thus, a developing toner cartridge has been conventionally used to supplement the developing toner to the developing toner supply device. The developing toner cartridge stores developing toner therein and is detachably installed into the casing of the developing toner supply device. The developing toner is supplemented from the inside of the developing toner cartridge through a casing side opening of the casing of the developing toner supply device to the casing. As described above, when the developing toner is stored in the developing toner cartridge and is supplemented to the developing toner supply device, the developing toner is prevented from being scattered. Thus, the hands of a user, a recording sheet, peripheral equipment and air are not made dirty, and the device is not obstructed. In contrast, when the developing toner is directly supplied to the casing of the developing toner supply device, developing toner can scatter during transfer.

One known cartridge has an opening formed on a cylindrical member to extend in the longitudinal direction and a shutter for opening and closing the opening rotatably secured along the outer peripheral surface of the cylindrical member. The opening is closed by the shutter when the developing toner cartridge is installed into the casing. It is opened by opening the shutter after the installation of the cartridge into the casing, so that the developing toner is allowed to be supplied into the developing toner supply device. The detachment of the developing toner cartridge from the casing is carried out after the opening is closed by the shutter.

In this type of developing toner cartridge, no developing toner attaches to the outer surface of the closed shutter when the developing toner cartridge is detached from the casing when all of the developing toner in the casing has been used. However, when the shutter is closed to detach the developing toner cartridge from the casing when developing toner remains in the casing, the shutter is moved by plowing through the developing toner to close the cartridge side opening. So, the developing toner attaches to the outer surface of the shutter. Therefore, the hands of the user, the recording sheet, etc. get dirty.

SUMMARY OF THE INVENTION

An object of this invention is to provide a developing toner supply device capable of avoiding attachment of developing toner to the outer surface of the developing toner cartridge.

To attain the above and other objects, a developing toner supply device includes a casing and a developing toner cartridge. The developing toner cartridge of the developing toner supply device contains a casing side opening and is formed in a vessel shape. The cartridge comprises a main body for storing the developing toner, a cartridge side opening provided in the main body for permitting flow-out of the developing toner therethrough, and a lid member which is movable between a closing position where the cartridge side opening is closed and an opening position where the cartridge side opening is opened. A shielding member is provided on the casing for shielding a portion of the lid member from the developing toner in the casing. The shielding member serves as an outer surface of the lid member when the cartridge is detached from the casing.

In the developing toner supply device the shielding member closely contacts the portion of the lid member serving as the outer surface when the cartridge side opening is opened and closed and is movable together with the lid member.

The lid member is formed in a semi-cylindrical shape and is rotated about a rotational axis at the center of the semi-cylindrical body between the closing position and the opening position. The lid member has a passageway through which the cartridge side opening and the casing side opening are intercommunicated with each other. The shielding member is formed in a semi-cylindrical shape having the same radius as the lid member and is rotatably supported by the casing.

According to the developing toner supply device, when the developing cartridge is installed to the casing and the lid member is moved to the opening position, the developing toner is permitted to be supplied to the casing. The casing is provided with the shielding member that shields the outer surface of lid member when the developing toner cartridge is detached from the casing from the developing toner inside of the casing. Thereby, the developing toner inside of the casing is prevented from attaching to the outer surface of the lid member.

When the lid member is moved between the opening and closing positions, the portion of the lid member serving as the outer surface of the lid member when the cartridge is detached from the casing closely contacts with the shielding member. Thus, the portion is covered by the shielding member not only in a state where the cartridge side opening is opened, but also when the cartridge side opening is opened and closed. So, the developing toner hardly attaches to the portion.

When the cartridge side opening is opened and closed, the lid member is rotated between the opening and closing positions. The cartridge side opening and the casing side opening intercommunicate with each other through the passageway formed inside of the lid member at the opening position, thereby supplying the developing toner through the inside of the lid member.

The semi-cylindrical shielding member and the semi-cylindrical lid member closely contact with each other at both flat end surfaces thereof to form a cylinder. Both of the members are rotated by rotating at least one of the members, so that the cartridge side opening is opened and closed. The portion of the lid member that serves as the outer surface of the lid member when the cartridge is detached from the casing is shielded from the developing toner inside of the casing by the shielding member to prevent attachment of the developing toner to the outer surface of the lid member. Therefore, toner scattering through the detachment of the developing toner cartridge hardly occurs. Thus, the removal of developing toner cartridge can be excellently carried out without staining the hands of a user, a recording sheet, etc. Of course, if the outer surface of the lid member is shielded from the developing toner inside of the casing by the shielding member at all times, the developing toner is completely prevented from attaching to the outer surface. Besides, if the shielding is carried out at least when the developing toner is liable to attach to the outer surface of the lid member, the developing toner will hardly attach to the outer surface.

The outer surface of the lid member is shielded by the shielding member not only when the cartridge side opening is opened, but also when the lid member is moved between the opening and closing positions. So, the developing toner will hardly attach to the outer surface of the lid member even when it remains in the casing, and no scattering of the developing toner will occur. Therefore, the developing toner cartridge can be detached from the casing very excellently.

The lid member is formed in a semi-cylindrical shape. It is moved in a space corresponding to its semi-cylindrical body with the center of the semi-cylinder being the central axis thereof. So, the space for the motion of the lid member is made small. In addition, the passageway is formed inside of the lid member, and thus it is not required to be provided at the outside of the lid member. So, the device can be compactly designed in compact size.

Since the shielding member is formed in the semi-cylindrical shape having the same radius as the lid member, the space for the motion of the lid member corresponds to a cylinder formed by the shielding member and the lid member. Thus, the cylinder may be small, so that the device can be compactly designed.

Further, the outer peripheral surface of both the lid member and the shielding member can be supported by a cylindrical surface. Thus, the support of these members can be more facilitated than in a case where the lid member and the shielding member must be provided with a separate support member.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

Preferred embodiments in which this invention is applied to a device for supplying powdery developing toner to a developing device of an electrophotographic recording apparatus are described in detail with reference to the accompanying drawings.

Figure 10:
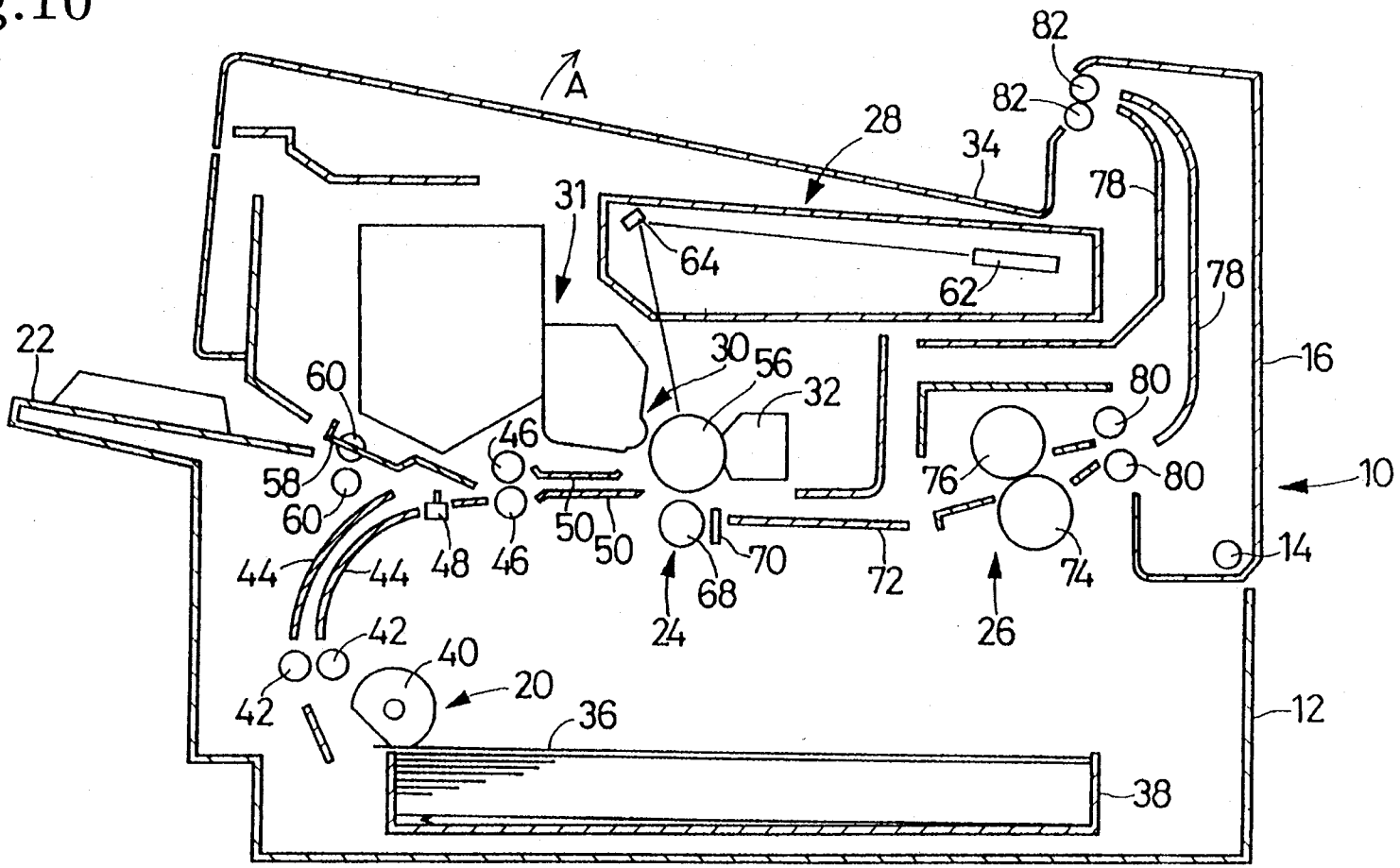
FIG. 10 is a front cross-sectional view schematically showing an electrophotographic recording apparatus equipped with the developing toner supply device of this invention and the developing device.

The schematic construction of an electrophotographic recording apparatus to which this embodiment is applied is first described with reference to FIG. 10.

The electrophotographic recording apparatus 10 comprises a vessel-shaped fixed housing 12 and a movable housing 16 that is rotatably secured to the fixed housing 12 through a shaft 14 to close an opening of the fixed housing 12.

The fixed housing 12 is provided with a automatic sheet supply device 20, a manual sheet-inserting table 22, an image transfer device 24 and a fixing device 26. The movable housing 16 is provided with an exposure device 28, a developing device 30, a developing toner supply device 31, a cleaning device 32 and a sheet discharge tray 34.

When sheets 36 are supplied as a recording medium by the automatic sheet supply device 20, the sheets 36 are accommodated in a sheet cartridge 38 and set up at the bottom portion of the fixed housing 12. The automatic sheet supply device 20 has a feed-out roller 40, that feeds the sheets 36 in the sheet cartridge 38 out one by one. After being fed out, a sheet 36 is fed to a pair of resist rollers 46 by a pair of feeding rollers 42 and a pair of guides 44 to adjust its attitude. The resist rollers 46 are normally stopped and start rotation after a predetermined fine time elapses from detection of the sheet 36 by a sheet detection sensor 48 at the upstream side to adjust the attitude of the sheet 36. After adjustment of the sheet 36, the sheet 36 is guided by a pair of guides 50 and fed to a gap between the photosensitive drum 56 and the image transfer device 24 to transfer an image.

The manual sheet-inserting table 22 is provided at the edge of the opening of the fixed housing 12. In operation, the user places the sheets 36 on the manual sheet-inserting table 22 one by one. The sheet placed on the table is fed through the sheet detection sensor 48 to the resist rollers 46 by the guide 58 and the pair of feeding rollers 60.

The photosensitive drum 56 is rotatably supported by the fixed housing 12, and it is exposed to light by the exposure device 28 to form an electrostatic latent image thereon. The exposure device 28 includes a laser beam emitting unit 62 having a laser for emitting a laser beam according to recording data that is prepared beforehand. A polygon mirror for reflecting the laser beam, and a mirror 64 for reflecting the laser beam emitted from the laser beam emitting unit 62 to irradiate the laser beam onto the photosensitive drum 56 also makes up the exposure device 28. The photosensitive drum 56 is successively exposed to light at every line to form an electrostatic latent image. Toner, serving as the developing toner, is attached to the electrostatic latent image on the photosensitive drum 56 by the developing device 30 to execute a developing process. Then, the toner is transferred onto the sheet 36 by the image transfer device 24. The toner not transferred to the sheet and thus remaining on the photosensitive drum 56 is removed by the cleaning device 32.

The image transfer device 24 has a image transfer roller 68 that supplies the sheet 36 with charge and transfers toner attached onto the photosensitive drum 56 to the sheet 36. The sheet is discharged by a discharger 70 after the image transfer process and then guided to the fixing device 26 by the guide 72. The fixing device 26 has a heating roller 74 and a press roller 76. The image is fixed by heating, and the sheet 36 is fed to a pair of sheet discharge rollers 82 provided at the upper portion of the movable housing 16 by a pair of guides 78 and a pair of feeding rollers 80. Then, the sheet 36 is discharged to a sheet discharge tray 34 provided on the movable housing 16.

Figure 1A:
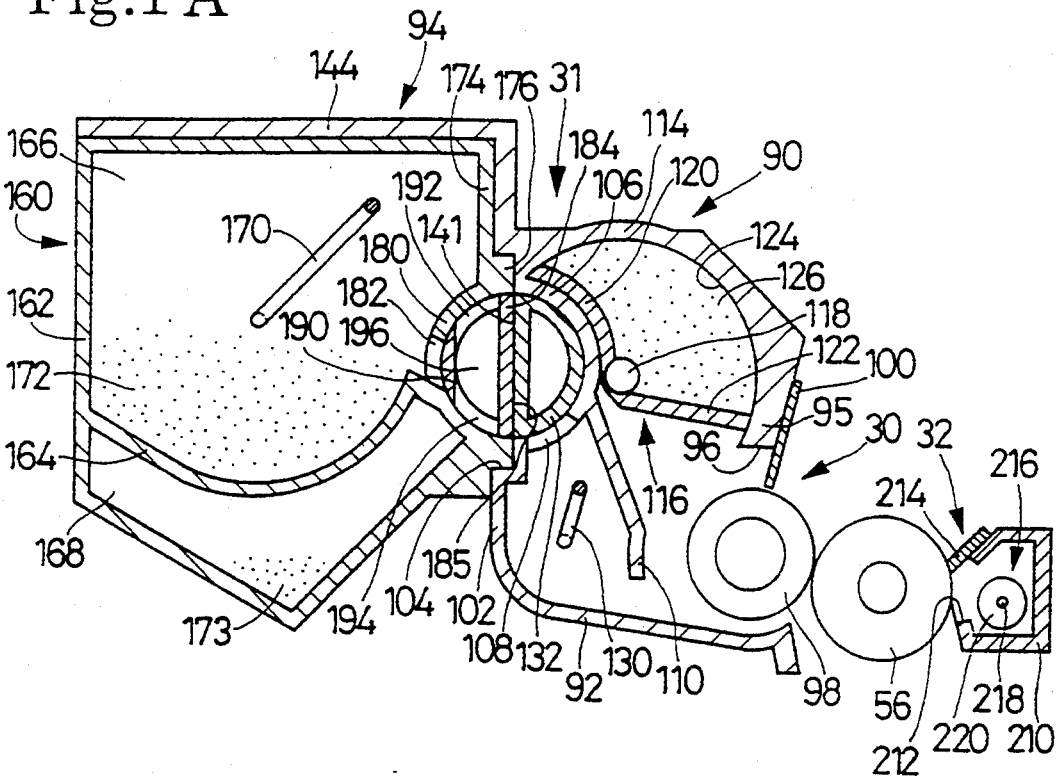
FIGS. 1A and 1B are front cross-sectional views of a developing device equipped with a developing toner supply device according to this invention.

As shown in FIG. 1A, the developing device 30 and the casing 90 of the developing toner supply device 31 are integrally constructed. This integral construction includes a box-shaped toner storing portion 92 extending in parallel to the rotational axis of the photosensitive drum 56 and a U-shaped cartridge mount portion 94 provided to extend from the toner storing portion 92 toward the opposite side to the photosensitive drum 56. The U-shaped cartridge mount portion 94 is fixed to the movable housing 16 and preferably not detachable therefrom.

An opening 96 extending in parallel to the rotational axis of the photosensitive drum 56 is formed at the front wall 95 of the toner storing portion 92 adjacent to the photosensitive drum 56. A developing roller 98 is secured to the front wall 95. The developing roller 98 comprises a magnet roller fixed to the movable housing 16, a non-magnetic sleeve which is rotatably supported on the surface of the magnet roller, and a magnetic brush for carrying toner formed on the surface of the non-magnetic sleeve by a carrier. A blade 100 is provided at the opening 96 to restrict the height of the magnetic brush. The developing roller 98 and the blade 100 principally constitute the developing device 30.

A recess portion 104 having a rectangular section extending in the longitudinal direction of the toner storing portion 92 is formed at a back wall 102 at the cartridge mount portion 94 side of the toner storing portion 92. A support wall 106 having a semi-annular section extending in the longitudinal direction of the toner storing portion 92 is formed at the bottom wall portion of the recess portion 104 projecting toward the front wall 95 side. A casing side opening 108 is formed at the peripheral edge portion of the support wall 106 extending in the longitudinal direction of the toner storing portion 92. A partitioning wall 110 is formed at the opposite position of the back wall 102 to the casing side opening 108 of the support wall 106 projecting toward the developing roller 98.

A support member 116 is secured in a space surrounded by the front wall 95 by a shaft 118, a ceiling wall 114, the support wall 106 and the partitioning wall 110 of the toner storing portion 92 to rotate around the axis in parallel to the longitudinal direction of the toner storing portion 92. The support member 116 has a pair of plate portions 120 and 122 extending from the shaft 118. A surface of the plate portion 120 which faces the support wall 106 is formed as a partially cylindrical surface having the same curvature as the outer peripheral surface of the support wall 106, and the other plate portion 122 is formed in a generally flat plate shape.

An inner surface 124 extending from the ceiling 114 to the front wall 95 is formed as a partially-cylindrical surface with the axial radial center of the shaft 118 at the center of the inner surface. The tip surfaces of the plate portions 120 and 122 are adjacent to the inner surface 124. The support member 116 is disposed at such a position that the plate member 120 contacts the support wall 106. The carrier dispersed with initial toner 126 is accommodated in the space surrounded by the ceiling wall 114 and the front wall 95 until the electrophotographic recording apparatus is used.

Figure 1B:
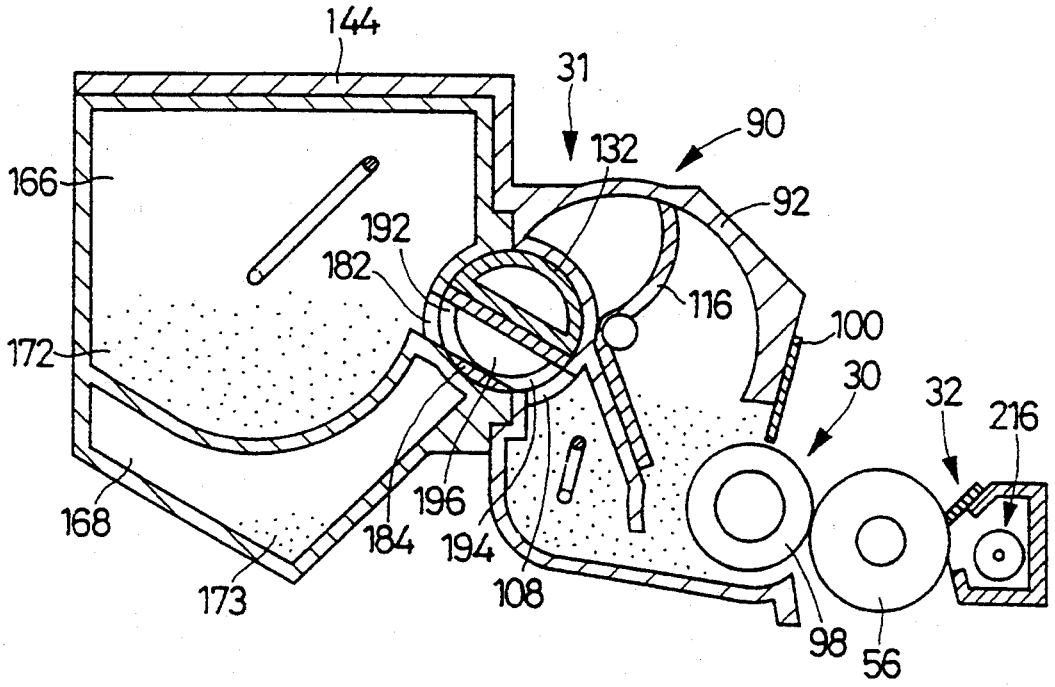
Figure 2:
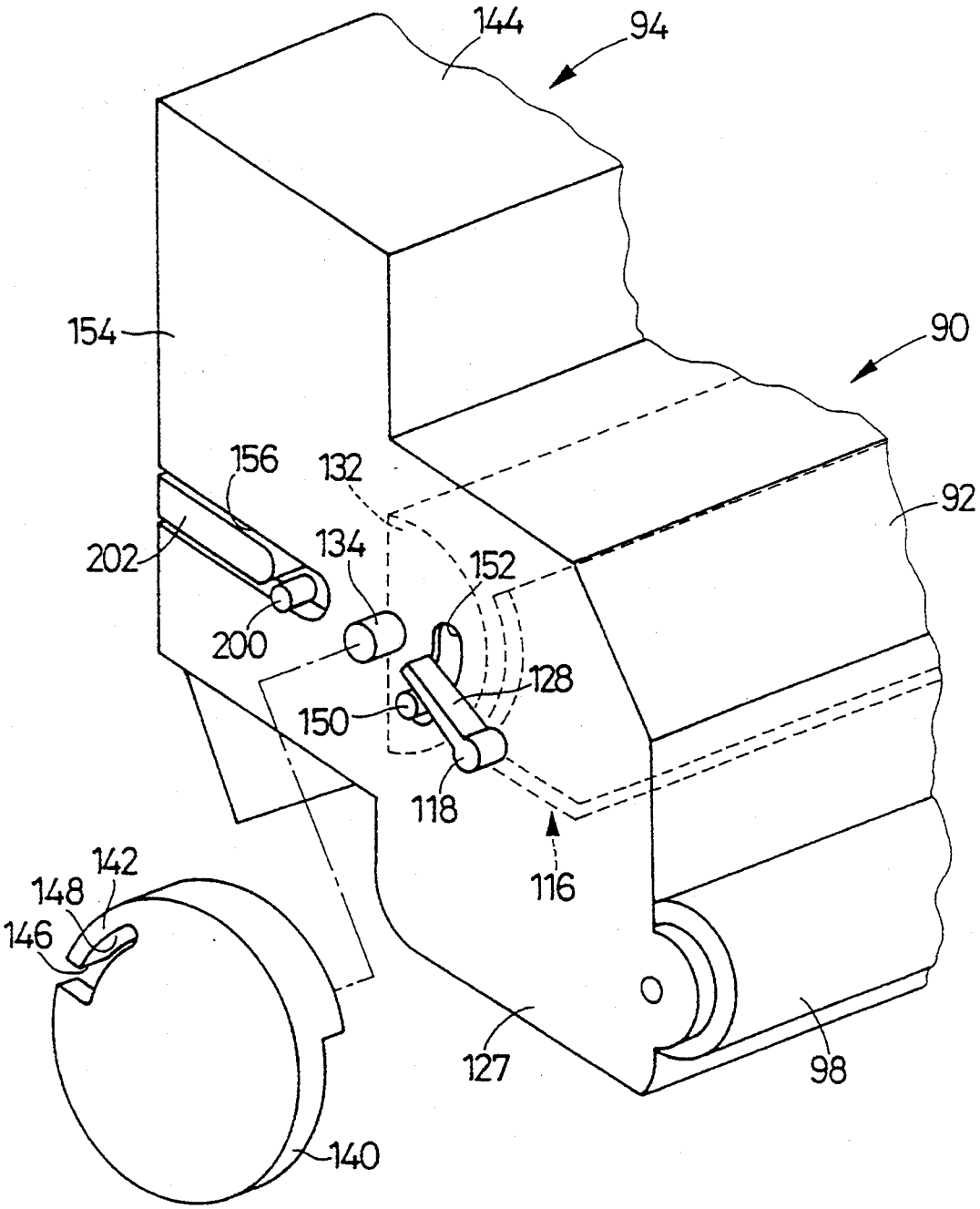
FIG. 2 is a perspective view of a main part of the developing toner supply device and the developing device according to this invention.

As shown in FIG. 2, the shaft 118 projects from the side wall 127 of the toner storing portion 92, and a lever 128 is secured to the projection end to project toward the side of the cartridge mount portion 94. A stirring member 130, shown in FIGS. 1A and 1B, is rotatably secured in a space below the support wall 106 in the toner storing portion 92 and stirs the toner as known.

Figure 4:
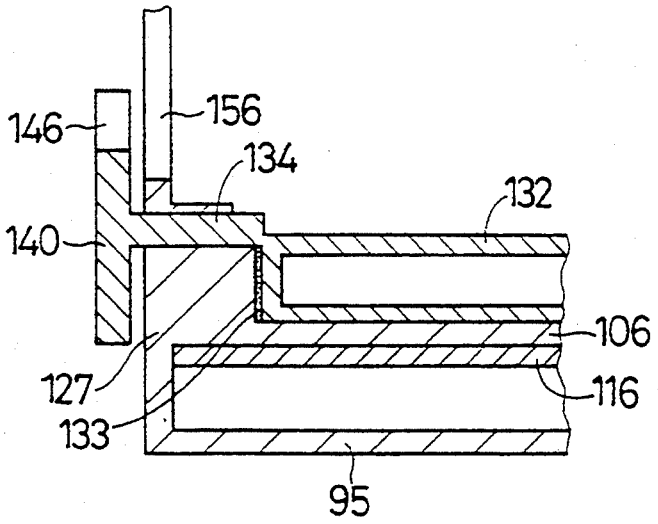
FIG. 4 is a plan cross-sectional view of one end portion of a casing of the developing toner supply device of this invention.
Figure 5:
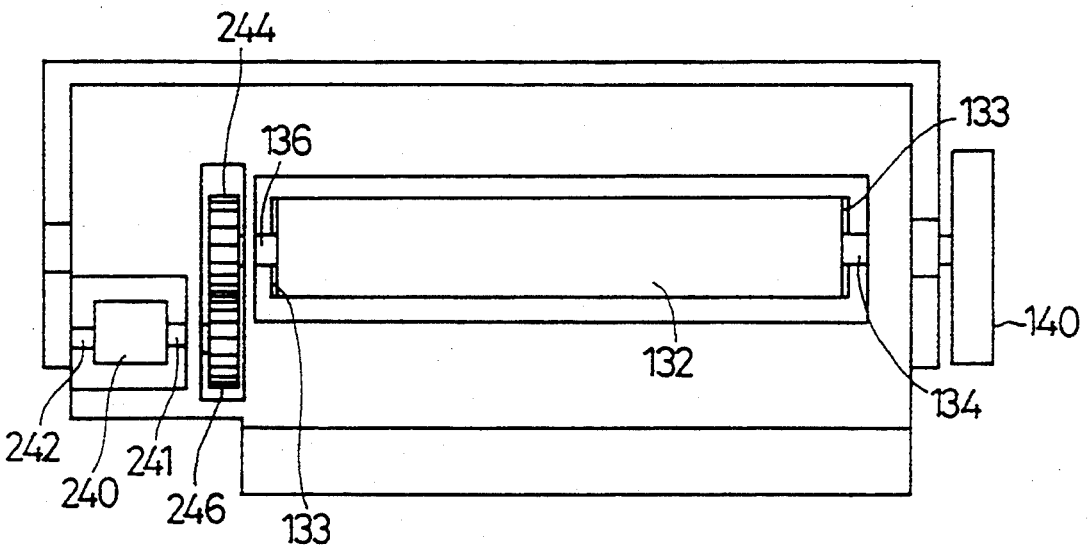
FIG. 5 is a back view of the casing of the developing toner supply device of this invention.

A semi-cylindrical casing side rotating member 132 serving as a shielding member is rotatably engaged with the support wall 106. As shown in FIGS. 4 and 5, a friction member 133 serves as frictional force generating means and is made of felt or some similar material. The friction member 133 is secured to each of the surfaces of the support wall 106 that support respective end surfaces at both ends of the casing side rotating member 132 in its longitudinal direction where a frictional force occurs between the friction member 133 and the end surface of the casing side rotating member 132. The frictional force generating means may also be secured to the casing side rotating member 132.

As shown in FIG. 5, shafts 134 and 136 coaxially project at both end surfaces of the casing side rotating member 132 in its longitudinal direction respectively and are rotatably supported by the casing 90. The shaft 134 projects from the side wall 127 and a disk-shaped thumbscrew 140 is secured to the projecting end of the shaft 134. By rotating the thumbscrew 140, the casing side rotating member 132 can be rotated between a closing position where the casing side opening 108 is closed as shown in FIG. 1A and an opening position where the casing side opening 108 is opened as shown in FIG. 1B. At the closing position, the flat side surface 141 of the casing side rotating member 132 forms the outer surface of the casing 90.

As shown in FIG. 2, a hook 142 is formed in the thumbscrew 140. A radial cutout 146 located in the same plane as the shaft 134 opens on the outer peripheral surface of the thumbscrew 140 so as to extend in parallel to the ceiling wall 144 of the cartridge mount portion 94. A peripheral cutout 148 extends from the radial cutout 146 in a direction opposite to the rotating direction from the closing position of the casing side rotating member 132 to the opening position thereof. The peripheral cutout 148 constitutes a partial ring with the rotational axis of the casing side rotating member 132 at the center thereof, and the combination of these cutouts 146 and 148 constitutes an arc-shaped hook 142.

A projection 150 projects in a direction parallel to the rotational axis from the end surface of the casing side rotating member 13 where the thumbscrew 140 is secured, as shown in FIG. 2, through curved elongated hole 152 formed at the side wall 127 to the outside. The projection 150 is disposed at the upstream side in a rotating direction from the closing position of the casing side rotating member 132 to the opening position thereof with respect to the lever 128. The elongated hole 152 is formed in an arc shape with the rotating axis of the casing side rotating member 132 at the radial center thereof. The projection 150 engages with the end portion of the lever at the upstream side of the elongated hole 152 in the rotating direction when the casing side rotating member 132 is in the closing position.

As shown in FIG. 2, the side wall 154 of the cartridge mount portion 94 has a cutout 156 that is disposed in the same plane as the shaft 134 and opens at the end surface of the opposite side of the cartridge mount portion 94 to the toner storing portion 92. The cutout 156 extends in parallel to the ceiling wall 144.

Figure 3:
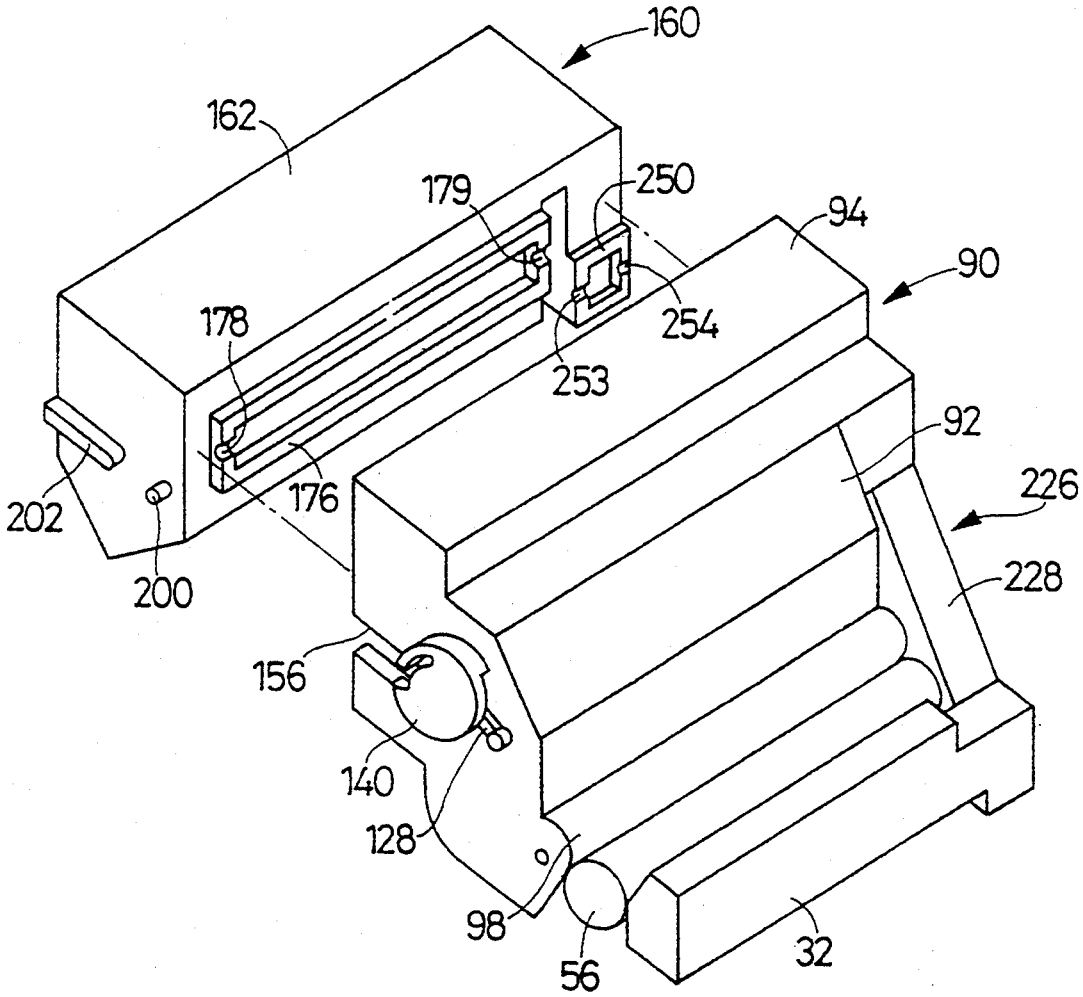
FIG. 3 is a perspective view of the developing toner supply device and the developing device according to this invention.

The cartridge mount portion 94 of the casing 90 is secured to the toner cartridge 160 as shown in FIGS. 1A and 3. The main body 162 of the toner cartridge 160 is designed in a longitudinal vessel shape as shown in FIG. 3. A partition wall 164 is provided inside of the main body 162 as shown in FIG. 1A to form an unused toner storing room 166 and a discharged toner storing room 168. The unused toner 172, serving as developing toner, is stored in the unused toner storing room 166 and stirred by a stirring member 170 as known. The discharged toner 173 that is scraped off the photosensitive drum 56 after the image transfer process is stored in the discharged toner storing room 168.

At a portion of the front wall 174 of the body 162 at the casing 90 side, adjacent the unused toner storing room 166A, is a projecting portion 176 having a rectangular section which engages with the recess portion 104 of the toner storing portion 92. Semi-cylindrical bearings 178 and 179 for supporting the pair of shafts 134 and 136 are provided in the projecting portion 176, as shown in FIG. 3. A semi-annular support wall 180, having the same diameter as the support wall 106, is formed in the projecting portion 176 and projects into the unused toner storing room 166.

A cartridge side opening 182 extending in the longitudinal direction is formed in the support wall 180, and a semi-cylindrical cartridge side rotating member 184 serving as the lid member is rotatably engaged with the support wall 180. The cartridge side rotating member 184 rotates between the closing position where the cartridge side opening 182 is closed and the opening position where the cartridge side opening 182 is opened. When the toner cartridge 160 is detached from the casing 90, the cartridge side opening 182 is closed, and the flat side surface 185 of the cartridge side rotating member 184 serves as the outer surface of the toner cartridge 160. Shown in FIG. 7, a friction member 187 serving as the frictional force generating means comprises a piece of felt or similar material secured to each of the surfaces of the support wall 180 supporting both end surfaces of the cartridge side rotating member 184 in its longitudinal direction. A frictional force occurs between both end surfaces of the cartridge side rotating member 184. The frictional force generating means may also be secured to the cartridge side rotating member 184.

Figure 6:
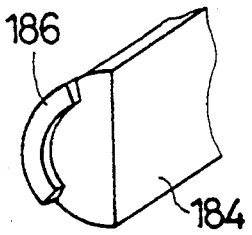
FIG. 6 is a partial perspective view of one end portion of a cartridge side rotating portion of a toner cartridge of the developing toner supply device according to this invention.
Figure 7:
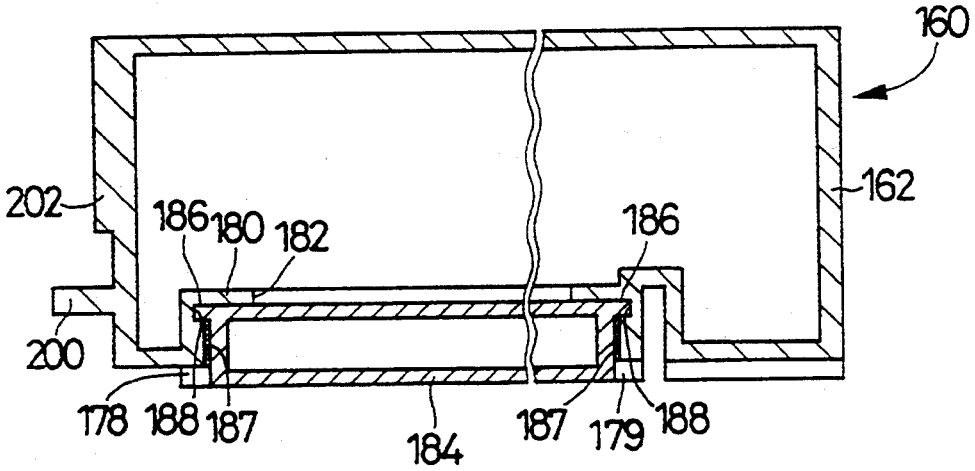
FIG. 7 is a top cross-sectional view of the toner cartridge.

The cartridge side rotating member 184 has the same radius as the casing side rotating member 132 and, as shown in FIG. 6, arc-shaped ribs 186 formed at both end portions of the cartridge side rotating member 184 in its longitudinal direction. The ribs 186 engage with a pair of arc-shaped grooves 188 formed in the main body 162, as shown in FIG. 7. The cartridge side rotating member 184 rotates and is prevented from being separated from the support wall 180. On the semi-cylindrical wall 190 of the cartridge side rotating member 184 are a pair of openings 192 and 194 that extend in parallel to the longitudinal direction of the semi-cylindrical wall 190. Inside of the cartridge side rotating member 184 a passageway 196 extends from the opening 192 to the opening 194.

Seen in FIG. 3, a projection 200 is provided at the front side portion of the outside surface of the main body 162. A guide rail 202 extending from the rear toward the front is provided at the rear side portion of the outside surface of the main body 162, spaced from the projection 200.

As shown in FIG. 1A, the cleaning device 32 has a casing 210, an opening 212 formed at the side of the photosensitive drum 56 in the casing 210, and a scraper plate 214 secured at the opening 212 that scrapes off toner attached to the photosensitive drum 56. The toner scraped off by the scraper plate 214 is carried to one end of the casing 210 by a first auger 216 provided in the casing 210. The first auger 216 comprises a shaft 218 rotatably supported by the casing 210 and a blade 220 spirally secured to the shaft 218.

As shown in FIG. 3, a discharged toner carrying device 226 is provided adjacent to one end portion of the cleaning device 32 in the longitudinal direction. A casing 228 of the discharged toner carrying device 226 is integrally formed with the casing 90 and slants upwardly from the lower side of the casing 210 of the cleaning device 32. Shown in FIG. 8A, a second auger 230 provided inside of the casing 228 carries the discharged toner 173 from the lower side to the upper side of the casing 228. At the upper end portion of the casing 228, a recess portion 234 having a rectangular section and a recess portion 236 having a semicircular section are formed. The recess portion 236 opens toward the rectangular-sectional recess portion 234. A discharged toner carrying passageway 238 allows the recess portion 236 and a space in the casing 228 to intercommunicate with each other.

Figure 9:
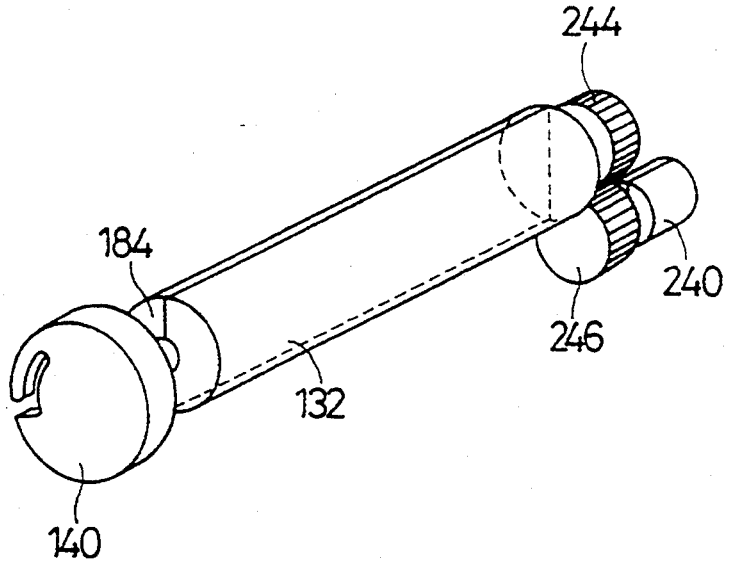
FIG. 9 is a perspective view of a rotation transmitting mechanism for a casing side rotating member of the developing toner supply device and a rotating member at a discharge toner carrying side of the discharge toner carrying device.

A discharge toner carrying side rotating member 240 is rotatably engaged with the recess portion 236. The discharged toner carrying side rotating member 240 is formed in a semi-cylindrical shape and is rotatably supported through shafts 241 and 242 projecting from both end surfaces thereof by the casing 228, as shown in FIG. 5. The rotation of the casing side rotating member 132 is transmitted to the discharged toner carrying side rotating member 240 by first and second gears 244 and 246, as shown in FIGS. 5 and 9. As shown in FIG. 5, the first gear 244 is secured to the shaft 136 at the side of the casing side rotating member 132 opposed to the side where the thumbscrew 140 is secured. The first gear 244 engages with the second gear 246, which is secured to the discharged toner carrying side rotating member 240. When the casing side rotating member 132 is rotated, the discharged toner carrying side rotating member 240 is simultaneously rotated in the opposite direction and moved between the closing position, where the discharged toner carrying passageway is closed, and the opening position, where the discharged toner carrying passageway is open. At the closing position, the flat side surface 248 of the discharged toner carrying side rotating member 240 serves as the outer surface.

Figure 8A:
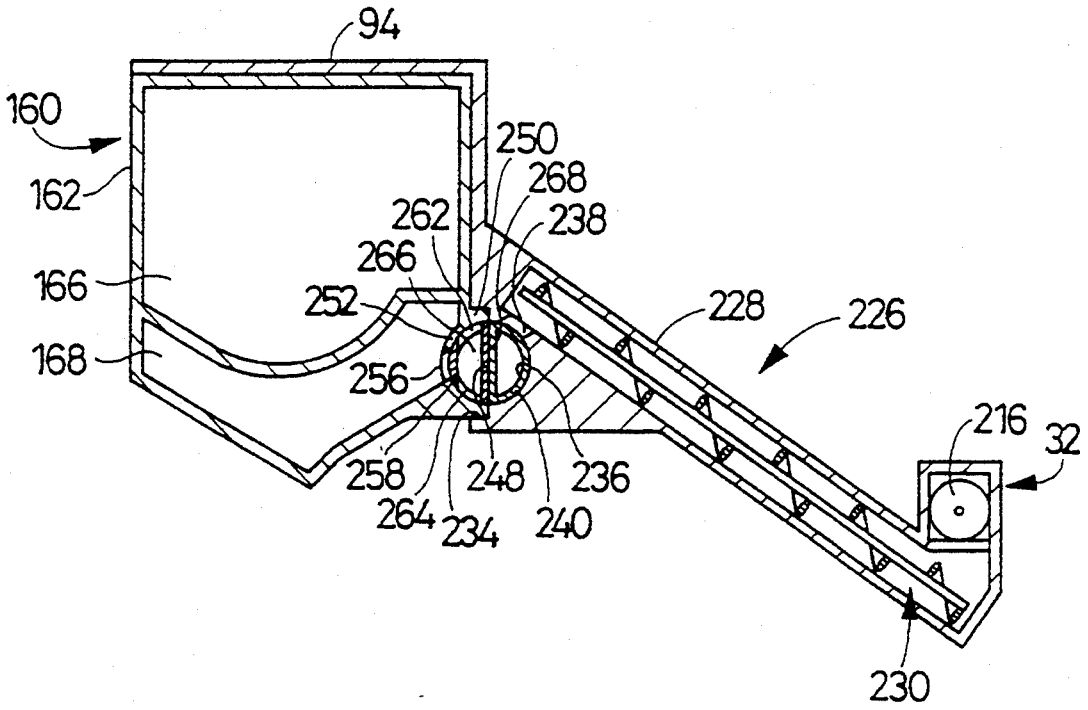
FIGS. 8A and 8B are front cross-sectional views of the toner cartridge and a discharge toner carrying device.

At a portion of the front wall 174 of the main body 162 of the toner cartridge 160 that partitions the discharged toner storing room 166, a projecting portion 250 having rectangular section is formed as shown in FIG. 8A. Also, semi-cylindrical bearings 253 and 254, shown in FIG. 3, are formed in the projecting portion 250 for supporting parts of the shafts 241 and 242 of the discharged toner carrying side rotating member 240.

As shown in FIG. 8A, an arcuate support wall 252 is formed at the projecting portion 250 to project toward the side of the discharged toner storing room 168. A discharged toner storing room side opening 256 is formed on the support wall 252 to open the discharged toner storing room 168 toward the outside. A semi-cylindrical discharged toner storing room side rotating member 258 is rotatably engaged with the discharged toner storing room side opening 256. The discharged toner storing room side rotating member 258 is moved between the closing position, where the discharged toner storing room side opening 256 is closed, and the opening position, where the discharged toner storing room side opening 258 is opened. The discharged toner storing room side rotating member 258 has the same radius as the discharged toner carrying side rotating member 240 and is formed with a pair of openings 262 and 264. In addition, a passageway 266 extends from the opening 262 to the opening 264 inside of the discharged toner storing room rotating member 258. The flat side surface 268 of the discharged toner storing room side rotating member 258 serves as an outer surface when the toner cartridge 160 is detached from the casing 90.

In the electrophotographic recording apparatus thus constructed, the toner cartridge 160 is not installed into the casing 90 when the apparatus is shipped but is installed into the casing 90 when the apparatus is started to be used. Therefore, before the cartridge is installed, as shown in FIGS. 1A and 8A, the casing side rotating member 132 and the discharged toner carrying side rotating member 240 are located at the closing position, and the support member 116 is located at a position where no initial toner 126 is supplied. In addition, the cartridge side rotating member 184 and the discharged toner storing room side rotating member 258 are also located at the closing position. These members are kept at the closing position by the frictional force which is caused at both end surfaces thereof in the longitudinal direction by the friction members 133 and 187.

Installing the toner cartridge 160 into the casing 90, the projecting portions 176 and 250 are engaged with the recess portions 104 and 234 of the casings 90 and 228, respectively. The guide rail 202 formed at the side surface of the toner cartridge 160 engages with the cutout 156 of the casing 90 when the movable housing 16 is opened in a direction as shown by an arrow A of FIG. 10. Once these projecting portions are engaged, the side surface 141 of the casing side rotating member 132 closely contact with the side surface 185 of the cartridge side rotating member 184, as shown in FIGS. 1A and 8A. The side surface 248 of the discharged toner carrying side rotating member 240 also closely contacts the side surface 268 of the discharged toner storing room side rotating member 258. Further, as shown in FIG. 11A, the projection 200 is inserted into the radial cutout 146.

Figure 11A:
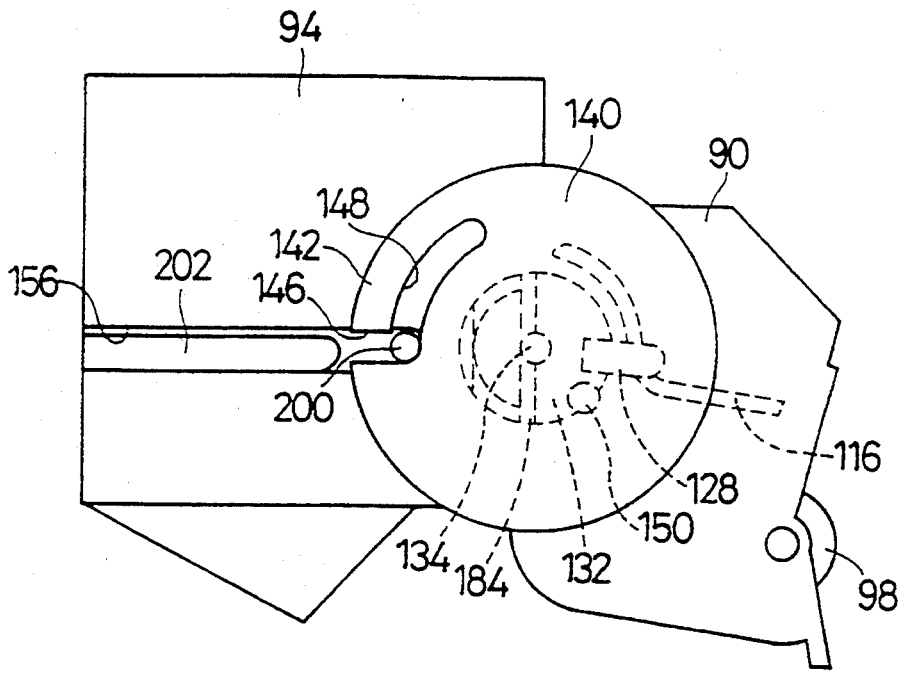
FIGS. 11A and 11B are diagrams showing the installation of the toner cartridge to the casing.

Therefore, by rotating the thumbscrew 140 counterclockwise as seen in FIG. 11A, the casing side rotating member 132 is rotated. Through this rotation, the cartridge side rotating member 184 is rotated in the same direction. As shown in FIG. 1B, the cartridge side opening 182 and the casing side opening 108 are opened and intercommunicated with each other through the passageway 196 formed inside of the cartridge side rotating member 184. Whereby, the toner 172 is allowed to be supplied from the unused toner storing room 166 to the casing 90.

Figure 8B:
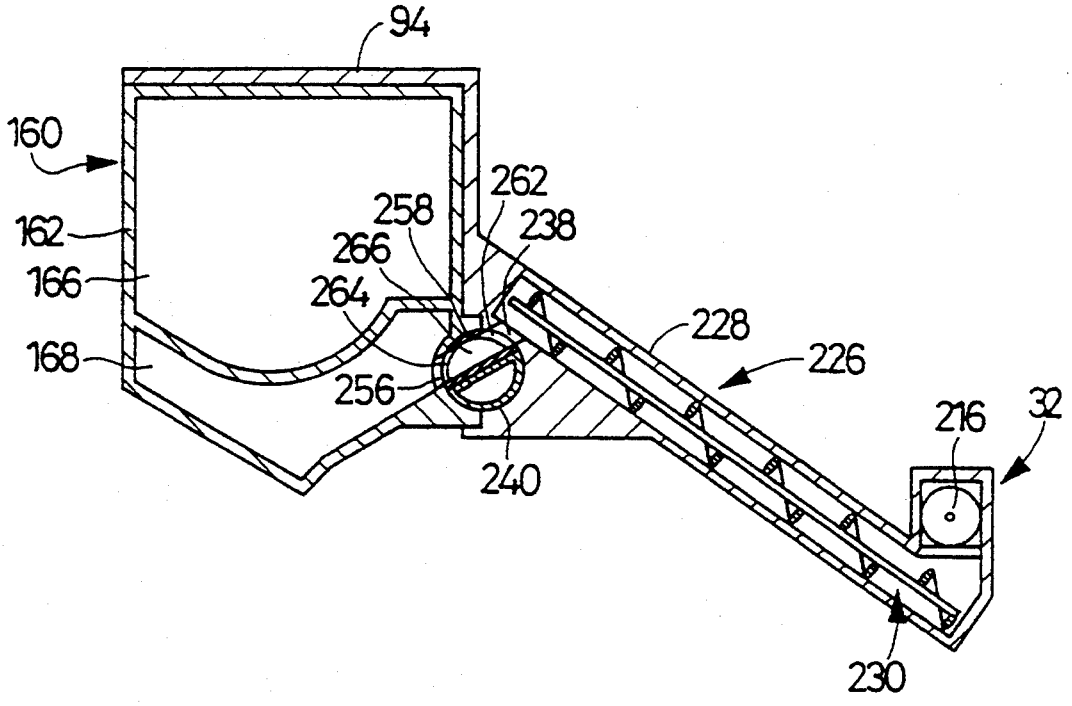

Through the rotation of the casing side rotating member 132, the projection 150 moves, thus pushing and rotating the lever 128. Accordingly, the support member 116 is rotated, so that the initial toner 126 falls onto the developing roller 98. Further, the rotation of the casing side rotating member 132 is transmitted to the discharged toner carrying side rotating member 240 by the first and second gears 244 and 246 to rotate the discharged toner carrying side rotating member 240. The discharged toner storing room side rotating member 258 is rotated so that, as shown in FIG. 8B, the discharged toner storing room opening 256 and the toner carrying passageway 238 are intercommunicated with each other through the passageway 266 formed inside of the discharged toner storing side rotating member 258. Thus, the discharged toner is allowed to flow into the discharged toner storing room 168.

Figure 11B:
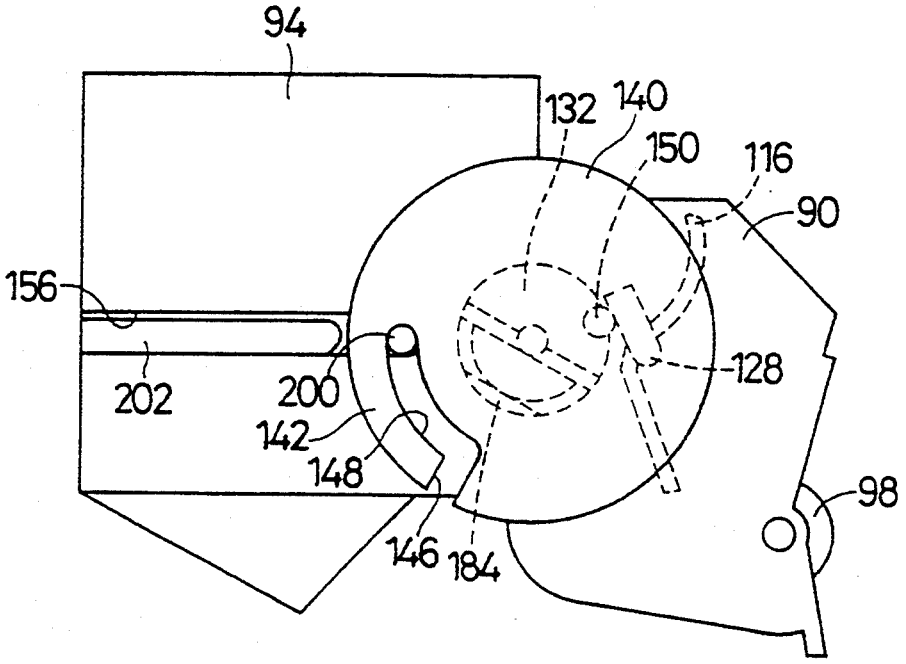

Further, through the rotation of the thumbscrew 140, the projection 200 is relatively moved inside of the peripheral cutout 148, as shown in FIG. 11B, and engaged with the hook 142. So, the toner cartridge 160 is prevented from falling off the casing 90 in its installing direction.

Upon manipulation of the thumbscrew 140, the intercommunication between the unused toner storing room 166 and the casing 90, the supply of the initial toner 126, the intercommunication between the discharged toner carrying passageway 238 and the discharged toner storing room 168, and the locking of the toner cartridge 160 are simultaneously carried out. The projection 150 projecting from the casing side rotating member 132, the elongated hole 152 and the lever 128 provided on the support member 116 primarily constitute an initial toner supply interlocking device for interlocking the supply of the initial toner 126 with the intercommunication between the unused toner storing room 166 and the casing 90. The first and second gears 244 and 246 primarily constitute a discharged toner interlocking device for interlocking the intercommunication between the discharged toner carrying passageway 238 and the discharged toner storing room 168. The hook 142 and the projection 200 primarily constitute a cartridge lock interlocking device for interlocking the lock of the toner cartridge 160.

When the toner cartridge 160 is installed as described above, the toner 172 is supplied to the casing 90, and the developing process is carried out. The discharged toner that remains on the photosensitive drum 56 without being transferred to the sheet 36 is scraped off by the scraper plate 214, is fed to the discharged toner carrying device 226 side by the first auger 216, falls into the casing 228, and is then carried by the second auger 230. The discharged toner is fed through the discharged toner carrying passageway 238, the passageway 266 and the discharged toner storing room side opening 256 and then stored into the discharged toner storing room 168.

When the toner cartridge 160 is detached from the casing 90, such as when the toner 172 inside of the unused toner storing room 166 of the toner cartridge 160 is completely used thus requiring replacement, the thumbscrew 140 is rotated clockwise, as shown in FIG. 11B. Through this operation, the casing side rotating member 132 is rotated, and the cartridge side rotating member 184 is rotated. So, the casing side opening 108 and the cartridge side opening 182 are closed, as shown in FIG. 1A. At the same time, the discharged toner carrying side rotating member 240 and the discharged toner storing room side rotating member 258 are rotated, and the discharged toner carrying passageway 238 and the discharged toner storing room side opening 256 are closed.

Further, the projection 200 is separated from the hook 142, and the lock of the toner cartridge 160 is released. So, the toner cartridge 160 is allowed to be drawn out of the casing 90 and detached from the casing 90.

The support member 116 is kept at the position of FIG. 1B without being rotated after it is once rotated to supply the initial toner 126. This is because the carrier is hardly consumed at the recording time and the initial toner 126 may be supplied when the electrophotographic recording apparatus is started to be used.

As described above, in the developing toner supply device 31 of this embodiment, the side surface 185 serving as the outer surface when the toner cartridge 160 of the cartridge side rotating member 184 is detached from the casing 90 closely contacts the side surface 141 of the casing side rotating member 132 when the toner cartridge 160 is attached to and detached from the casing 90. In this state, the casing side rotating member 132 is rotated by the manipulation of the thumbscrew 140 to open the casing side opening 108 and the cartridge side opening 182. These openings are kept in close contact with each other in an open state, so that no toner 172 is attached to the side surfaces 185 and 141. Thus, the hands of a user, the sheet 36, etc. are not stained by toner.

Similarly, the opening and closing operations of the discharged toner storing room side opening 256 of the discharged toner storing room 168 and the discharged toner carrying passageway 238 are carried out when the side surfaces 248 and 269 of the semi-cylindrical rotating members 240 and 258 are in close contact. This close contact is kept when the discharged toner is stored. So, the hands of the user, the sheet 36, etc. are prevented from being stained due to the scattering of the discharged toner 173.

The casing side rotating member 132 and the cartridge side rotating member 184 are designed in a semi-cylindrical shape and closely contact with each other to form a cylinder. So, the cartridge side rotating member 184 can be rotated by rotating the casing side rotating member 132. Therefore, no rotation operating device is required for the cartridge side rotating member 184, and the toner cartridge 160 can be simply constructed at a low price.

Further, the recess portion 104 of the casing 90 and the projecting portion 176 of the toner cartridge 160 function as positioning means for positioning the casing 90 and the toner cartridge 160 in a direction perpendicular to the cartridge installing direction through their engagement. Therefore, when the thumbscrew 140 is rotated, the toner cartridge 160 and the casing 90 are prevented from deviating in the perpendicular direction as described above. Thus, the casing side rotating member 132 and the cartridge side rotating member 184 are concentrically maintained and smoothly rotated.

For the discharged toner carrying side rotating member 240 and the discharged toner storing room rotating member 258, the projecting portion 250 and the recess portion 234 also function as positioning means. Through the engagement of these portions, the rotating members 240 and 258 can be concentrically maintained and smoothly rotated.

Further, when the openings are closed, the tip surface of the projecting portion 176, the tip surface of the projecting portion 250, the side surface 185 of the cartridge side rotating member 184 and the side surface 268 of the discharged toner storing room side rotating member 258 are located on the same plane in the direction perpendicular to the attaching and detaching direction of the toner cartridge 160. Accordingly, the cartridge side rotating member 184 and the casing side rotating member 132 closely contact each other. Also, the discharged toner storing room side rotating member 258 and the discharged toner carrying side rotating member 240 closely contact each other by pushing the toner cartridge 160 against the casing 90. Thus, the attaching and detaching operation of the cartridge can be easily carried out.

Still further, since the unused toner storing room 166 and the discharged toner storing room 168 are provided to the toner cartridge 160, the discharged toner storing room 168 is automatically detached simultaneously with the detachment of the toner cartridge 160. Thus, discard of the discharged toner 173 is not overlooked.

Still further, since the discharged toner storing room 168 is integrally provided to the toner cartridge 160, the set-up space thereof is reduced compared to when it is provided separately from the toner cartridge 160. Thus, the recording apparatus can be compactly designed.

The discharged toner storing room side opening 256 and the discharged toner carrying passageway 238 are opened and closed simultaneously with the opening and closing operation of the casing side opening 108 and the cartridge side opening 182 by the rotation of the casing side rotating member 132. So, the discharged toner 173 can be surely stored in the discharged toner storing room 168 without having to separately open and close the openings. Therefore, there is no scattering of the discharged toner 173 due to forgetting to close of the openings.

Figure 12:
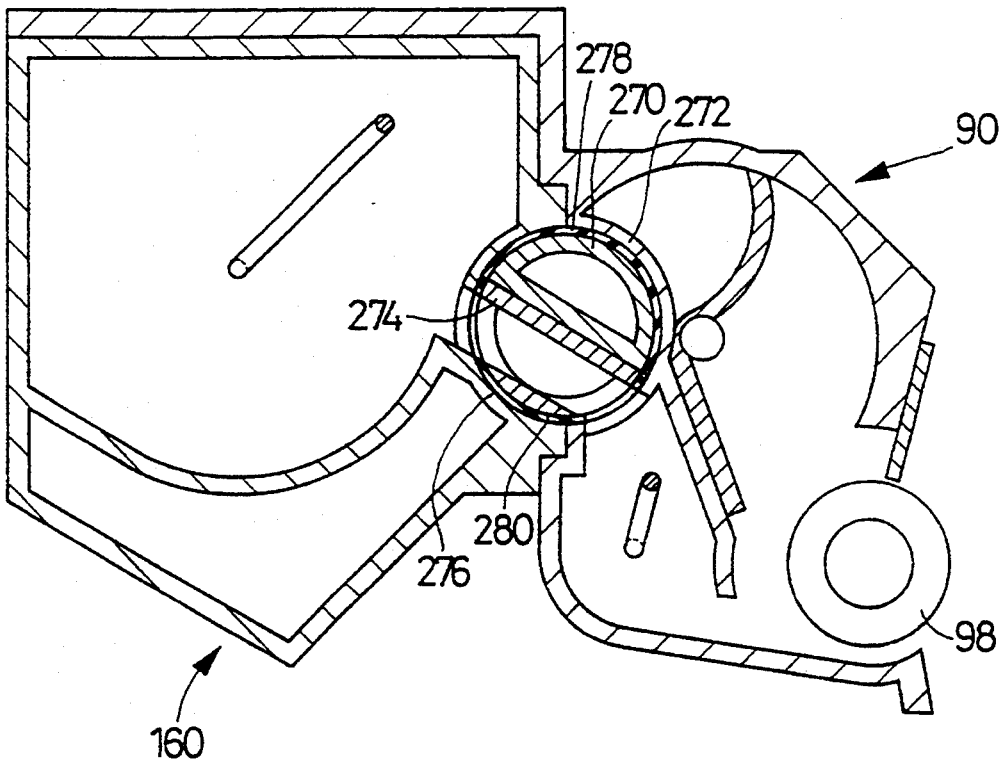
FIG. 12 is a front cross-sectional view of a developing device equipped with a developing toner supply device of another embodiment according to this invention.

As shown in FIG. 12, shielding members 278 and 280 may be made of rubber. They may be fixedly secured to either of the casing side rotating member 270 or the support wall 272 and either the cartridge side rotating member 274 or the support wall 276, respectively. With this construction, the leakage of the toner 172 can be surely prevented.

Figure 13:
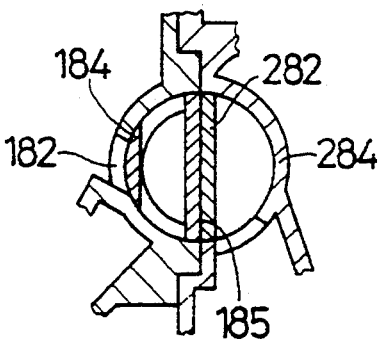
FIG. 13 is a front cross-sectional view of a main part of a developing toner supply device of another embodiment according to this invention.

In the embodiment as shown in FIGS. 1 to 11, the shielding member is designed in a semi-cylindrical shape. However, it may be designed as a plate member 282, as shown in FIG. 13. The plate member 282 is supported by the casing 90 through a pair of shafts (not shown) which extend from both ends thereof in the longitudinal direction to be concentric with the support wall 284. The plate member 282 closely contacts the side surface 185 of the cartridge side rotating member 184 to rotate the cartridge side rotating member 184. So, the toner is prevented from attaching to the outer surface of the cartridge side rotating member 184 when the cartridge side opening 182 is opened and closed and when the toner is supplied.

Figure 14:
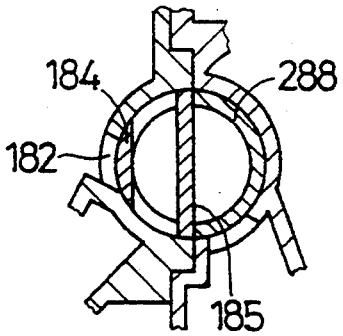
FIG. 14 is a front cross-sectional view of a main part of a developing toner supply device of another embodiment according to this invention.

Further, as shown in FIG. 14, a casing side rotating member of circular arc shape in section, in which the plate portion of the casing side rotating member 132 is omitted, may be used as the shielding member. The side surface 185 of the cartridge side rotating member 184 can be also shielded from the toner using this casing side rotating member 288.

Figure 15:
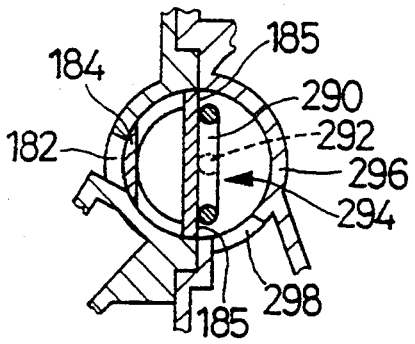
FIG. 15 is a front cross-sectional view of a main part of a developing toner supply device of another embodiment according to this invention.

In the embodiment shown in FIGS. 1 to 11, the casing side rotating member 132 may be omitted, and in place of the casing side rotating member 132, an exclusively-used opening and closing device for rotating the cartridge side rotating member 184 may be provided. For example, the opening and closing device is constructed as follows. As shown in FIG. 15, a rod member 290 having a circular section is bent in a rectangular shape, and shafts 292 (only one shaft 292 being shown in FIG. 15) projected from both end portions in the longitudinal direction of the opening and closing member extending in the longitudinal direction of the cartridge side rotating member 184. The shafts 292 are rotatably supported to the casing 90 to constitute the opening and closing device 294. Through rotation of the one shaft 292, the opening and closing member 290 is rotated, and the cartridge side rotating member 184 is pushed to be rotated.

In this case, by rotating the opening and closing member 290 counterclockwise in FIG. 15, the cartridge side rotating member 184 can be moved to the opening position. On the other hand, by rotating the opening and closing member 290 clockwise, the cartridge side rotating member 184 can be moved to the closing position. The arcuate support wall 296 functions as the shielding member. This is because when the cartridge side rotating member 184 passes by the casing side opening 298 and the cartridge side opening 182 and the casing side opening 298 intercommunicate with each other, the side surface 185 of the cartridge side rotating member 184 is covered by the support wall 296.

Further, in each of the embodiments as described above, the cartridge side rotating member 184 serves as the lid member. The cartridge side rotating member 184 is designed in a semi-cylindrical shape and is used as a rotating member that rotates with the center of the semi-cylinder being the rotational axis. Therefore, these embodiments have an inherent advantage that the forward and reverse rotation of the casing side rotating member 132 is transmitted to the cartridge side rotating member 184 only by contacting the cartridge side rotating member 184 with the semi-cylindrical casing side rotating member 132. Thus, the cartridge side rotating member 184 is opened and closed. However, the lid member may be designed as a rotating member that rotates around one axis.

Figure 16:
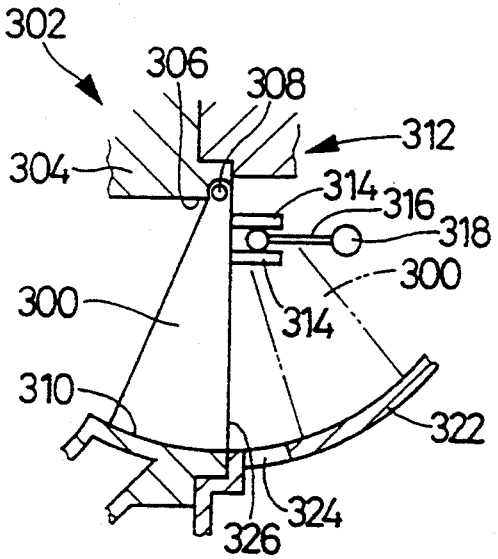
FIG. 16 is a front cross-sectional view of a main part of a developing toner supply device of another embodiment according to this invention.

For example, as shown in FIG. 16, the lid member may be designed like a sectorial member 300. A cartridge side opening 306 having a rectangular section is formed at the main body 304 of the toner cartridge 302. The sectorial member 300 is swingably secured to the cartridge side opening 306 through a shaft 308. The sectorial member 300 engages with a partially cylindrical surface 310 formed in the main body 304 to close the cartridge side opening 306. The cartridge side opening is provided separately from the sectorial member 300 serving as the lid member. A pair of projections 314 are provided at two spaced positions in the swing axis direction of the sectorial member 300 to project toward the casing 312 side. The tip portions of operating members 316 engage with a gap between the projections 314. These operating members 316 are secured to a common shaft 318 that is rotatably supported by the casing 312 and primarily constitute the opening and closing device.

When the opening 306 is opened, the shaft 318 is rotationally driven to rotate the operation members 316 clockwise in FIG. 16. Whereby, the sectorial member 300 is swung as indicated by a two-dot chain line. The casing 312 is provided with a support wall 322 having an arcuate section whose inner diameter is equal to the outer diameter of the sectorial member 300 and has a casing side opening 324. The sectorial member 300 swings along the inner peripheral surface of the support wall 322 to intercommunicate the cartridge side opening 306 and the casing side opening 324. The sectorial member 300 swings until it passes through the whole portion of the casing side opening 324 and the cartridge side opening 306 and the casing side opening 324 are intercommunicated with each other. The side surface 326 of the sectorial member 300 serves as the outer side thereof when the cartridge side opening 306 is closed and passes through the casing side opening 322. The sectorial member 300 is shielded from the toner by the support wall 322 so that it is hardly stained due to attachment of the toner.

In this case, the support wall 322 constitutes the shielding member and serves as a non-contact and position-fixing type of shielding member, unlike a close-contact type of shielding member closely contacted with the outer surface of the lid member and moved together with the lid member. The side surface 326 is shielded from the toner only when the cartridge side opening 306 is opened. Even if the toner remains in the casing 312 when the cartridge side opening 306 is closed, the toner is pushed by the sectorial member 300 and returned from the cartridge side opening 306 into the toner cartridge 302. No toner exists in a moving locus of the side surface 326 of the sectorial member 300. Thus, the toner is hardly attached to the side surface 326, not only when the cartridge side opening 306 is closed, but also when the cartridge side opening 306 is opened.

In the above embodiments, the toner cartridge 160 has the projecting portion 176 while the casing 90 is provided with the recess portion 104. However, the projecting portion and the recess portion may be provided on the casing 90 and the toner cartridge 160, respectively. Also, a plurality of projecting portions and recess portions may be provided in the longitudinal direction of the rotating members 132 and 184.

Further, in the above embodiments, the thumbscrew 140 is designed to be rotated by the user. However, it may be designed to be automatically rotated. For example, the movable housing 16 may be provided with an engaging member which is engaged with the thumbscrew 140 to rotate the thumbscrew 140 when the movable housing 16 is closed, thereby automatically rotating the thumbscrew 140.

Still further, in the above embodiments, the lid member is designed to be rotated or swung around one axis. However, it may be designed to be linearly movable. In this case, the shielding member may be linearly moved together with the lid member in close contact with the outer surface of the lid member. Alternatively, it may be designed so that it is positionally fixed like the support walls 296 and 322 and shields the outer surface of the lid member from the developing toner when the cartridge side opening is opened.

Other various modifications and improvements may be made to the above embodiments on the basis of the knowledge of the skilled persons in the art without departing from the subject matter of this invention.

What is claimed is:

1. A supply device, comprising:

a casing including a casing housing having a storing portion and a cartridge mount portion, said cartridge mount portion having a first opening and a first shielding member adjacent said first opening; and a cartridge detachably mounted on said cartridge mount portion of said casing, said cartridge including a cartridge housing with a storing room, a second opening in said storing room in selective communication with said first opening, and a lid coupled over said second opening and movable between an open position and a closed position, wherein when said lid is opened said first shielding member covers a portion of said lid and said first opening is in communication with said second opening.

2. The supply device of claim 1, wherein said casing is coupled to a developing device and communicates with a developing roller.

3. The supply device of claim 1, wherein said casing includes a support member defining said storing portion with said casing housing and rotatably disposed within said casing housing about an axis of rotation.

4. The supply device of claim 3, wherein said storing portion has a curved wall with a radius of curvature, and said axis of rotation of said support member being coincident with said radius of curvature of said curved wall, said support member comprising a curved plate and a flat plate joined at said axis of rotation.

5. The supply device of claim 1, wherein said first shielding member comprises an arcuate outer wall on said casing directly adjacent said first opening and configured to closely contact said lid when said lid is in said open position.

6. The supply device of claim 5, wherein said first shielding member further comprises a plate pivotally secured to said casing housing at said arcuate wall to pass over said first opening.

7. The supply device of claim 5, wherein said first shielding member further comprises an arcuate plate rotatably coupled to said casing housing against said arcuate outer wall to pass over said first opening.

8. The supply device of claim 1, wherein said first shielding member comprises a rotatable member coupled to said casing and disposed over said first opening and mating with said lid for movement between said open and said closed position.

9. The supply device of claim 8, wherein said casing housing has an arcuate outer wall and said first shielding member has a semi-circular cross section, said first shielding member rotatably mating with said arcuate wall.

10. The supply device of claim 8, further comprising a frictional member disposed between said first shielding member and said casing housing creating a frictional holding force to hold said first shielding member in a position.

11. The supply device of claim 1, wherein said casing has a cut out in said casing housing and said cartridge has a guide rail received in said cut out.

12. The supply device of claim 1, wherein said casing includes a support member rotatably disposed on a first shaft coupled to said casing housing and defining said storing portion with said casing housing, said first shaft extending outwardly from said casing housing and having a lever disposed thereon, and wherein said first shielding member comprises a rotatable member coupled to said casing, disposed over said first opening and mating with said lid for movement between said open and said closed positions, and a second shaft coupled to said rotatable member and protruding from said casing housing, said second shaft engaging said lever upon rotation of said lid between said open and closed positions to rotate said support member to open said storing portion.

13. The supply device of claim 12, wherein a thumbscrew with an arc shaped hook is secured to said second shaft, and said hook engages said lid of said cartridge to simultaneously rotate said lid with said shielding member.

14. The supply device of claim 1, wherein said lid of said cartridge comprises a rotatable member disposed over said second opening and coupled to said cartridge for movement between said open and said closed positions.

15. The supply device of claim 14, wherein said housing of said cartridge has an arcuate outer wall and said lid has a semi-circular cross section, said lid rotatably mating with said arcuate wall.

16. The supply device of claim 14, further comprising a frictional member disposed between said lid and said housing of said cartridge creating a frictional holding force to hold said lid in a position.

17. The supply device of claim 14, wherein said lid has a passageway therethrough extending between said second opening and said first opening in said open position.

18. The supply device of claim 14, wherein said rotatable member has opposed ends with arcuate ribs thereon, said ribs engaging said housing of said cartridge.

19. The supply device of claim 1, wherein said casing further comprises a cleaning assembly including a passage having two openings, a cleaning device disposed in a first cleaning device opening and a second shielding member disposed in a second cleaning device opening, said second cleaning device opening being in selective communication with said cartridge.

20. The supply device of claim 19, wherein said passage has an auger disposed therein for moving debris from said cleaning device to said cartridge.

21. The supply device of claim 19, wherein said cartridge further comprises an additional storing room with an opening and a closing member in communication with said cleaning assembly, said closing member movable between an open and a closed position.

22. The supply device of claim 21, wherein said second shielding member comprises an arcuate outer wall and said closing member closely mates with said arcuate wall when moved to the open position.

23. The supply device of claim 22, wherein said second shielding member further comprises a semi-cylindrical member rotatably disposed in said second cleaning device opening.

24. The supply device of claim 22, wherein said closing member comprises a semi-cylindrical member.

25. The supply device of claim 24, wherein said closing member has a passageway therethrough extending between said additional storing room and said cleaning assembly to establish the open position.

26. The supply device of claim 22, further comprising a frictional member disposed between said closing member and said housing of said cartridge creating a frictional holding force to hold said closing member in a position.

27. A developing toner supply device, including:

a casing for storing developing toner, having a side with a casing opening therein and a shielding member; and a developing toner cartridge detachably installed on said casing for supplementing developing toner through said casing opening, said developing toner cartridge having a main body for storing the developing toner, a cartridge opening provided in said main body for allowing flow-out of the developing toner, and a lid member disposed over said cartridge opening and movable between a closed position and an open position, wherein said shielding member shields a portion of said lid member from the developing toner in said casing that forms an outer surface of said cartridge when said cartridge is detached from said casing.

28. The developing toner supply device as claimed in claim 27, wherein said shielding member closely contacts said lid member and is movable together with said lid member.

29. The developing toner supply device as claimed in claim 27, wherein said lid member has a semi-cylindrical shape with a radial center and is rotated about said radial center between said closed and open positions, said lid member having therein a passageway for intercommunicating said cartridge opening with said casing opening when said lid member is in said open position.

30. The developing toner supply device as claimed in claim 29, wherein said shielding member has a semi-cylindrical shape with the same radial center as said lid member and is rotatably supported by said casing, said shielding member and said lid member being rotatable together.

* * * * *